US011057698B2

(12) United States Patent
Wu et al.

(10) Patent No.: US 11,057,698 B2
(45) Date of Patent: Jul. 6, 2021

(54) SPEAKER

(71) Applicant: AAC Technologies Pte. Ltd., Singapore (SG)

(72) Inventors: Shuwen Wu, Shenzhen (CN); Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,827

(22) Filed: Dec. 8, 2019

(65) Prior Publication Data

US 2020/0213720 A1 Jul. 2, 2020

(30) Foreign Application Priority Data

Dec. 27, 2018 (CN) ..... 201822221214.8

(51) Int. Cl.
*H04R 9/06* (2006.01)
*H04R 1/28* (2006.01)
*H04R 9/02* (2006.01)

(52) U.S. Cl.
CPC ..... *H04R 1/2834* (2013.01); *H04R 9/027* (2013.01); *H04R 9/06* (2013.01)

(58) Field of Classification Search
CPC combination set(s) only.
See application file for complete search history.

(56) References Cited

U.S. PATENT DOCUMENTS 10,631,097 B2 * 4/2020 Liu ..... H04R 9/06
10,820,107 B2 * 10/2020 Feng ..... H04R 9/041
2020/0045426 A1 * 2/2020 Song ..... H04R 7/127

* cited by examiner

*Primary Examiner* — Amir H Etesam
(74) *Attorney, Agent, or Firm* — W&G Law Group LLP

(57) ABSTRACT

The present invention discloses a speaker, including a holder, a vibration unit and a magnetic circuit unit that are fixed to the holder. The magnetic circuit unit includes a yoke fixed to the holder, a main magnet and an auxiliary magnet that are assembled on the yoke. The main magnet is spaced apart from the auxiliary magnet to form a first magnetic gap. The yoke includes a bottom wall and a sidewall formed by extending from a periphery of the bottom wall while being bent. The main magnet and the auxiliary magnet are assembled on the bottom wall. The auxiliary magnet is provided along a long axis direction of the bottom wall. The sidewall is located in a short axis direction of the bottom wall, and the sidewall is spaced apart from the main magnet to form a second magnetic gap.

8 Claims, 5 Drawing Sheets

A–A

SPEAKER

TECHNICAL FIELD

The present invention relates to the field of electroacoustic conversion, and in particular, to a speaker.

BACKGROUND

With the advent of the mobile internet era, more and more smart mobile devices emerge. Among the numerous mobile devices, mobile phones are undoubtedly the common and portable mobile terminal devices. At present, the mobile phones have extremely diverse functions, one of which is high-quality music displaying. Therefore, speakers for playing sound are widely used in today's smart mobile devices.

A speaker in the related art includes a holder, a magnetic circuit unit and a vibration unit that are received in the holder. The magnetic circuit unit is configured to drive the vibration unit to vibrate and sound. The magnetic circuit unit includes a yoke, a main magnet and an auxiliary magnet that are fixed on the yoke. The main magnet and the auxiliary magnet are spaced apart to form a magnetic gap.

However, the yoke of the speaker known in the related art has a flat-plate structure, and the auxiliary magnet is usually provided only in a long axis direction of the yoke. Thus, no such a structure exists in a short axis direction of the yoke to form a magnetic gap with the main magnet. In this way, it is impossible to provide the vibration unit with magnetic conduction to in the short-axis direction of the yoke, thereby affecting a performance of the speaker.

Therefore, it is urgent to provide an improved speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will hereinafter be described in detail with reference to several exemplary embodiments. To make the technical problems to be solved, technical solutions and beneficial effects of the present invention more apparent, the present invention is described in further detail together with the figure and the embodiments. It should be understood the specific embodiments described hereby is only to explain the invention, not intended to limit the invention.

Figure 1:
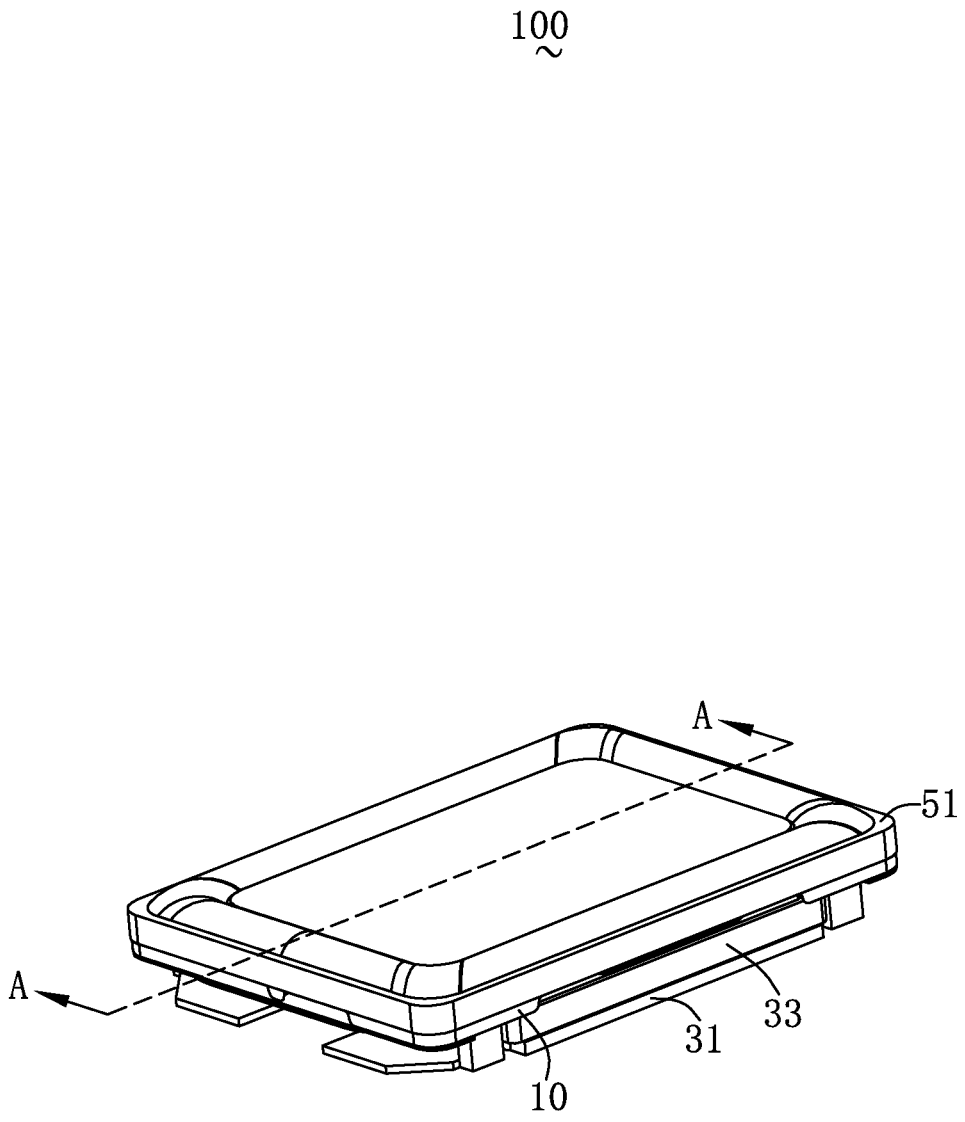
FIG. 1 is a perspective structural schematic diagram of a speaker according to the present invention.
Figure 2:
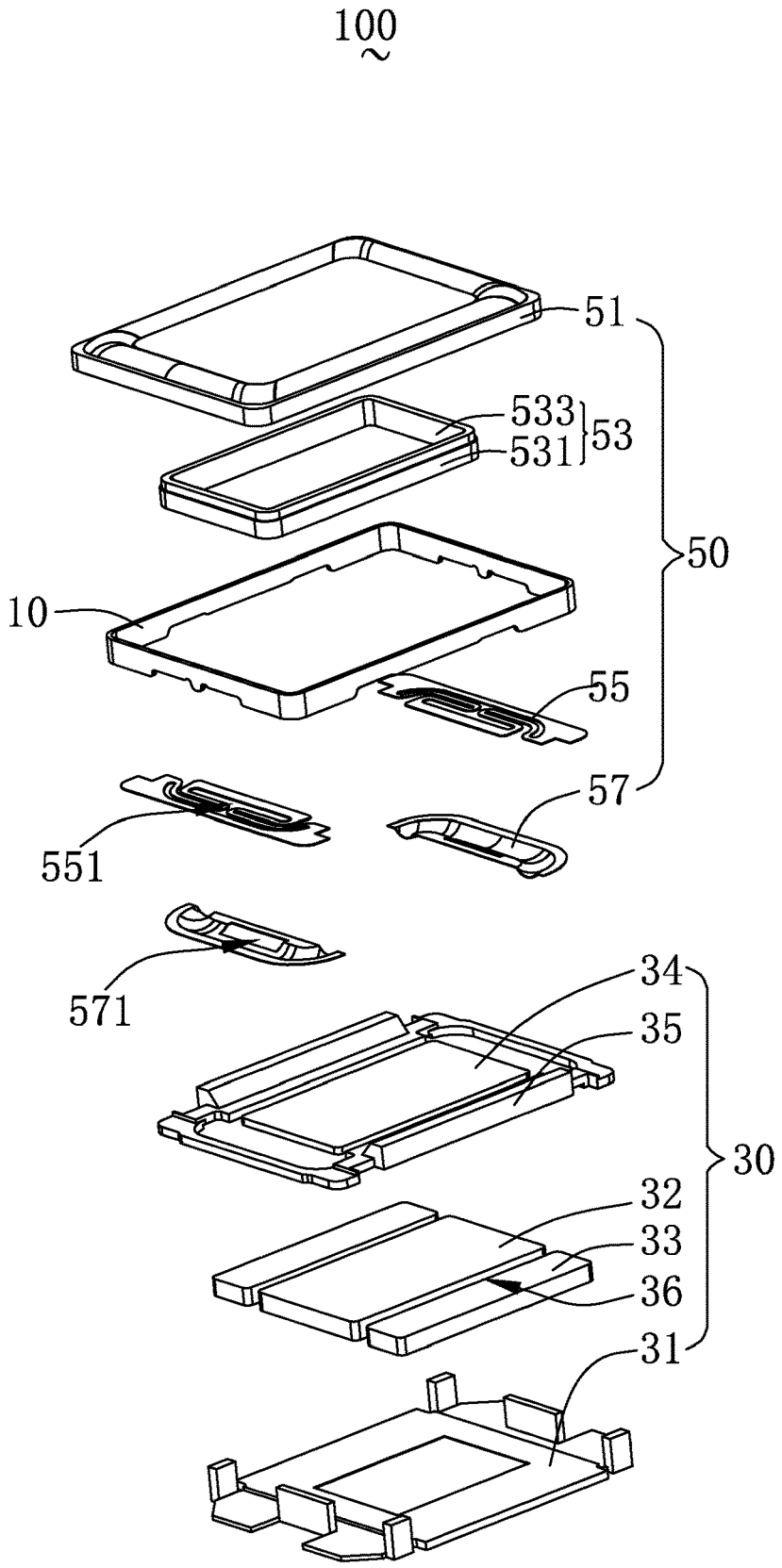
FIG. 2 is an exploded structural schematic diagram of the speaker shown in FIG. 1.

Referring to FIG. 1 and FIG. 2, the present invention provides a speaker 100, which includes a holder 10, a magnetic circuit unit 30 and a vibration unit 50 that are fixed to the holder 10. The magnetic circuit unit 30 is configured to drive the vibration unit 50 to vibrate.

The holder 10, as a whole, has a hollow rectangular shape.

The magnetic circuit unit 30 includes a yoke 31 fixed to the holder 10, a main magnet 32 and an auxiliary magnet 33 that are assembled on the yoke 31, a main pole plate 34 affixed to the main magnet 32, and an auxiliary pole plate 35 affixed to the auxiliary magnet 33. The main magnet 32 is spaced apart from the auxiliary magnet 33 to form a first magnetic gap 36.

Figure 3:
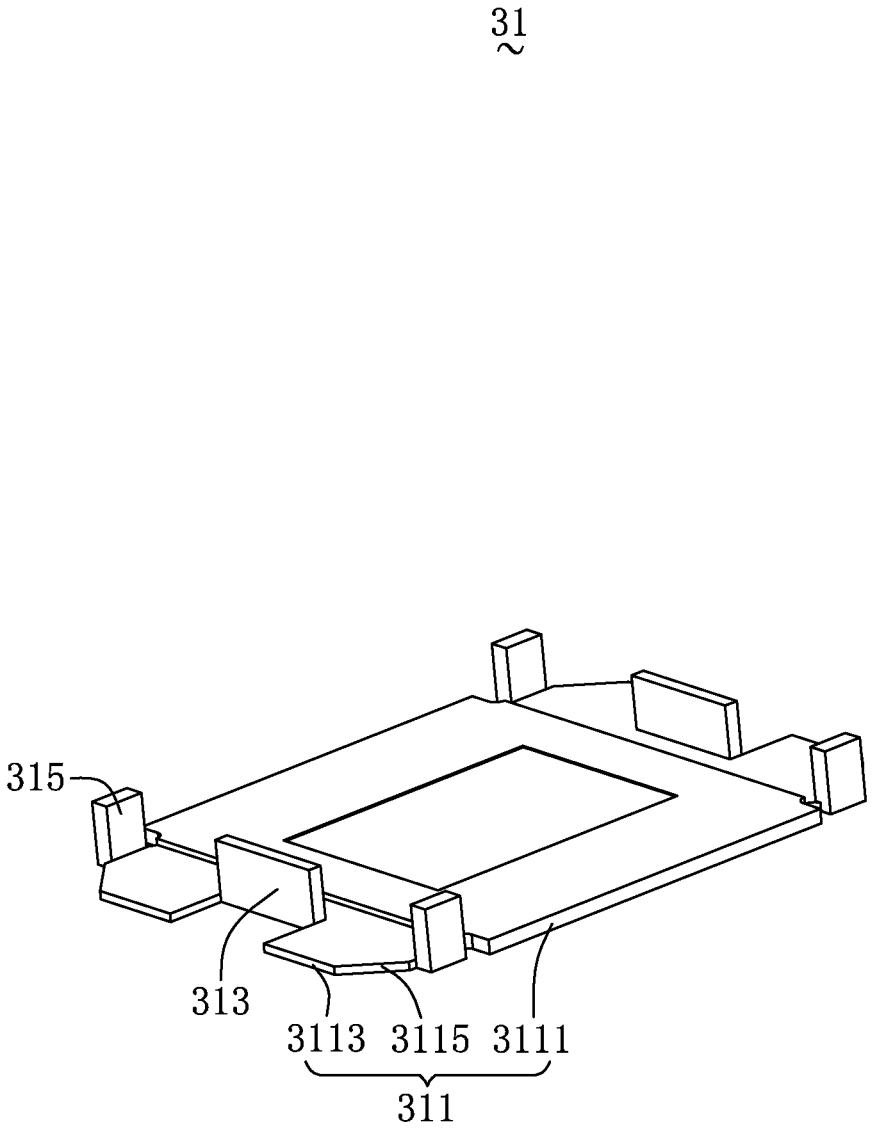
FIG. 3 is a structural schematic diagram of a yoke shown in FIG. 2.
Figure 4:
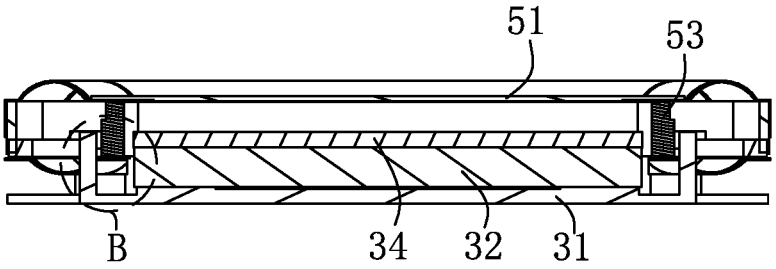
FIG. 4 is a cross-sectional view taken along line A-A shown in FIG. 1.
Figure 5:
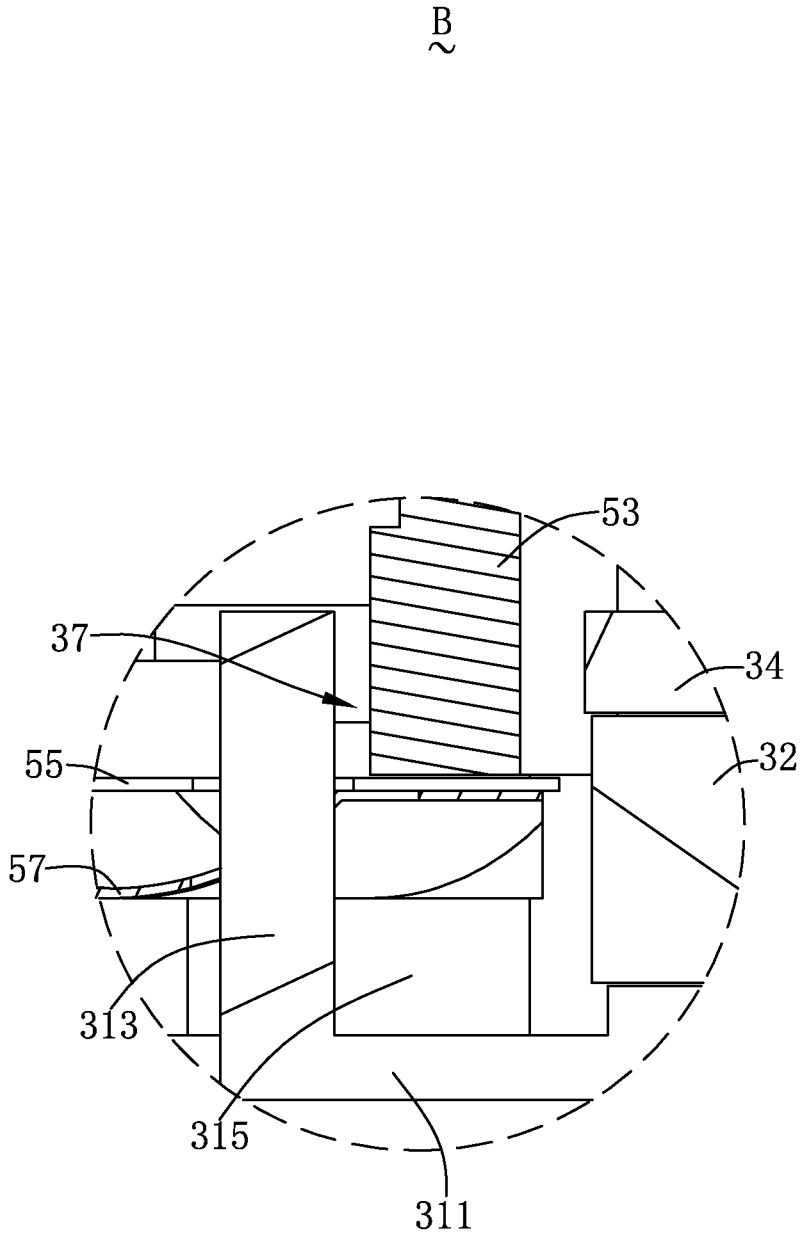
FIG. 5 is a partially enlarged view of an area B shown in FIG. 4.

In combination with FIG. 3 to FIG. 5, the yoke 31 includes a bottom wall 311, sidewalls 313 formed by extending from a periphery of the bottom wall 311 while being bent, and fixing walls 315. The main magnet 32 and the auxiliary magnet 33 are both assembled on the bottom wall 311. The main magnet 32 is located at the center of the bottom wall 311. The auxiliary magnet 33 is provided along a long axis direction of the bottom wall 311. The sidewall 313 is located in a short axis direction of the bottom wall 311. The long axis direction of the bottom wall 311 and the short axis direction of the bottom wall 311 are perpendicular to each other. The sidewall 313 is spaced apart from the main magnet 32 to form a second magnetic gap 37.

The bottom wall 311 has a flat-plate shape. In an embodiment, the bottom wall 311 includes two long side edges 3111 provided along the long axis direction, two short side edges 3113 provided along the short axis direction, and connecting edges 3115. Each of the connecting edges 3115 connects the long side edge 3111 and the short side edge 3113 that are adjacent. Four connecting edges 3115 are respectively provided the positions corresponding to ends of the long side edges 3111 and the short side edge 3113.

The sidewall 313 is located at an intermediate portion of the short side edge 3113. In an embodiment, two sidewalls 313 are provided. The two sidewalls 313 are respectively correspondingly provided on the two short side edges 3113, and the two sidewalls 313 are opposite to and spaced apart from each other. In this way, the two sidewalls 313 are respectively spaced apart from the main magnet 32 to form two second magnetic gaps 37.

The fixing walls 315 are fixedly connected to the holder 10. In an embodiment, each fixing wall 315 is located on the long side edge 3111 and close to a side of the connecting edge 3115. Four fixing walls 315 are provided, and each two of the four fixing walls 315 are provided two ends of one of the two long side edges 3111.

Further referring to FIG. 2, two auxiliary magnets 33 are provided. The two auxiliary magnets 33 are spaced apart from the main magnet 32 to form two first magnetic gaps 36.

The vibration unit 50 includes a first diaphragm 51 fixed to the holder 10, a voice coil 53 located under the first diaphragm 51 and configured to drive the first diaphragm 51 to vibrate and sound, a flexible printed circuit board 55 opposite to the first diaphragm 51 and elastically supporting the voice coil 53, and a second diaphragm 57 provided on a side of the flexible printed circuit board 55 facing away from the voice coil 53.

The voice coil 53 has a rectangular shape. In an embodiment, the voice coil 22 includes two opposite long-axis edges 531, and two short-axis edges 533 connecting the two long-axis edges 531. The short-axis edges 533 and the long-axis edges 531 are connected via arcuate transitions. The two long-axis edges 531 are partially located in the two first magnetic gaps 36 correspondingly, and the two short-axis edges 533 are partially located in the two second magnetic gaps 37.

The flexible printed circuit board 55 and the second diaphragm 57 are both fixed to a side of one short-axis edge 533 of the voice coil 53. A first avoiding portion 551 is provided at a position of the flexible printed circuit board 55 corresponding to the sidewall 313. A second avoiding portion 571 is provided at a position of the second diaphragm 57 corresponding to the sidewall 313. The first avoiding portion 551 and the second avoiding portion 571 are right facing to each other and are both configure to avoid the sidewall 313, i.e., the sidewall 313 passes through the second avoiding portion 571 and the first avoiding portion 551 correspondingly.

In an embodiment, two flexible printed circuit boards 55 and two second diaphragms 57 are provided. Each of two flexible printed circuit boards 55 and each of the two second diaphragms 57 are provided on each of the short-axis edges 533 of the voice coil 53.

Compared with the related art, in the speaker of the present invention, the sidewall, which is provided on the bottom wall of the yoke and in the short axis direction of the bottom wall, forms the second magnetic gap with the main magnet, and thus provides the vibration unit with magnetism conduction in the short axis direction of the bottom wall of the yoke. Moreover, the auxiliary magnet is provided along the long axis direction of the bottom wall, such that the yoke can provide the vibration unit with the magnetism conduction in both the long axis direction and the short axis direction, thereby increasing a response speed and a response amplitude of the speaker and further improving an application performance of the speaker.

The above described embodiments are merely intended to illustrate the present invention, and it should be noted that, without departing from the inventive concept of the present invention, the improvements made by those skilled in the related art shall fall within the protection scope of the present invention.

What is claimed is:

1. A speaker, comprising:

a holder;

a vibration unit fixed to the holder; and a magnetic circuit unit fixed to the holder, wherein the magnetic circuit unit comprises a yoke fixed to the holder, a main magnet and an auxiliary magnet that are assembled on the yoke, and the main magnet is spaced apart from the auxiliary magnet to form a first magnetic gap, the yoke comprises a bottom wall and a sidewall formed by extending from a periphery of the bottom wall while being bent, the main magnet and the auxiliary magnet are assembled on the bottom wall, the auxiliary magnet is provided along a long axis direction of the bottom wall, the sidewall is located in a short axis direction of the bottom wall, and the sidewall is spaced apart from the main magnet to form a second magnetic gap, the bottom wall comprises two long side edges arranged along the long axis direction, two short side edges arranged along the short axis direction, and connecting edges, each of the connecting edges connects one of the two long side edges and one of the two short side edge that are adjacent, and the sidewall is located at an intermediate portion of any one of the two short side edges.

2. The speaker as described in claim 1, wherein two sidewalls are provided, the two sidewalls are respectively disposed correspondingly to the two short side edges, and the two sidewalls are opposite to and spaced apart from each other.

3. The speaker as described in claim 1, wherein the yoke further comprises a fixing wall, the fixing wall is formed by extending from the periphery of the bottom wall while being bent and fixedly connected to the holder, and the fixing wall is located on any one of the two long side edges and is close to one of the connecting edges.

4. The speaker as described in claim 3, wherein four fixing walls are provided, and each two of the four fixing walls are provided on one of the two long side edges.

5. The speaker as described in claim 1, wherein the magnetic circuit unit further comprises a main pole plate affixed to the main magnet, and an auxiliary pole plate affixed to the auxiliary magnet.

6. The speaker as described in claim 1, wherein the vibration unit comprises a first diaphragm, a voice coil fixed under the first diaphragm, a flexible printed circuit board opposite to the first diaphragm and elastically supporting the voice coil, and a second diaphragm provided on a side of the flexible printed circuit board facing away from the voice coil.

7. The speaker as described in claim 6, wherein the voice coil has a rectangular shape, the voice coil comprises two long-axis edges opposite to each other, and two short-axis edges connecting the two long-axis edges, the two long-axis edges are at least partially located within the first magnetic gap, and the two short-axis edges are at least partially located within the second magnetic gap.

8. The speaker as described in claim 7, wherein the flexible printed circuit board and the second diaphragm are both fixed to a side of one of the two short-axis edges of the voice coil, a first avoiding portion is provided at a position of the flexible printed circuit board corresponding to the sidewall, and a second avoiding portion is provided at a position of the second diaphragm corresponding to the sidewall.

* * * * *